US005988284A

United States Patent [19]

Dea

[11] Patent Number: 5,988,284

[45] Date of Patent: Nov. 23, 1999

[54] METHOD AND APPARATUS FOR ENHANCING WELL PERFORMANCE

[75] Inventor: Thomas M. Dea, Denver, Colo.

[73] Assignee: Layne Christensen Company, Mission Woods, Kans.

[21] Appl. No.: 08/950,352

[22] Filed: Oct. 14, 1997

[51] Int. Cl.[6] ..... E21B 43/02

[52] U.S. Cl. ..... 166/369; 166/115; 166/187

[58] Field of Search ..... 166/369, 68, 68.5, 166/105, 107, 115, 116, 187

[56] References Cited

U.S. PATENT DOCUMENTS

| | | | |
|---|---|---|---|
| 2,290,431 | 7/1942 | Hoffman | 166/369 |
| 2,374,922 | 5/1945 | Byrd | 166/369 |
| 4,605,067 | 8/1986 | Burton, Jr. | 166/369 |
| 5,082,053 | 1/1992 | Bernhardt | 166/369 |

OTHER PUBLICATIONS

Seal Well brochure by Gordon L. Newby, Inc.

*Primary Examiner*—William Neuder
*Attorney, Agent, or Firm*—Shook, Hardy & Bacon LLP

[57] ABSTRACT

A shroud which surrounds a submersible pump is lowered into a water well along with a column pipe which carries the pump. The pump is located below the top of a screen which provides a perforated portion of the well casing. The shroud has an open bottom end located below the pump. An inflatable bladder attached to the shroud can be inflated through an inflation hose extending to the surface. The shroud may be connected with the column pipe by radial arms which maintain an open flow path between the column pipe and shroud. Water which falls in the casing when the pumping level drops below the top of the screen is not subject to aeration from the surface because of the seal provided by the bladder. The shroud around the pump creates a vacuum effect which increases the well capacity.

12 Claims, 1 Drawing Sheet

METHOD AND APPARATUS FOR ENHANCING WELL PERFORMANCE

FIELD OF THE INVENTION

This invention relates generally to water wells. More particularly, the invention relates to equipment which is useful to enhance the performance of deep wells, along with a method of using the equipment to achieve enhanced well performance and capacity and to prevent air entrainment by creation of a vacuum.

BACKGROUND OF THE INVENTION

In recent years, water levels in aquifers have been dropping steadily and often dramatically. In many areas, annual drops in the water level have been 20–40 feet on average. Water wells typically are lined with casings having screens or other perforated areas located below the water level in the aquifers. This allows the surrounding water to flow into the well and rise in the casing to the static aquifer level. A pump is installed in the well and operates to pump water through a column pipe which extends to the surface.

In conventional practice, the pump intake is normally located above the level of the screen, and the pump normally draws down the water level inside the casing only to a level which is above the top of the screen. However, when the aquifer level drops significantly, it is often necessary to lower the pump intake to a level below the top of the screen. Because the pump normally draws the water level down inside of the well faster than water can flow into the well, the water level in this situation can be drawn down below the top screen/perforations.

This creates a number of problems, principally caused by water falling inside of the casing as it enters through the upper perforations. This falling water entrains air and can result in unduly aerated water being pumped from the well. The aerobic conditions that are created are ideal for growth of bacteria and can lead to bacterial contamination and plugging of the well. Another problem is that cavitation effects can cause the pump to fail prematurely. All of these problems resulting from falling water in the well can cause its capacity to decrease, often alarmingly.

SUMMARY OF THE INVENTION

The present invention is directed to a system which overcomes these problems in order to enhance the well performance, increase well capacity, prolong the life of the pumping equipment, and reduce well maintenance requirements.

In accordance with the invention, a method and apparatus is provided which creates a vacuum applied to substantially the entirety of the screened area of the well casing. A shroud, which surrounds the pump, may be connected with the column pipe by radial arms which maintain an annular flow passage between the column pipe and shroud. In locations where attaching the assembly to the column pipe is not practical, the apparatus can be set into the well independent of the pumping equipment. In this application, the bottom of the liner is set on the bottom of the well. The bottom end of the shroud has openings and is located well below the pump. The shroud is lowered into the well along with the column pipe and pump to the desired location of the pump intake.

An inflatable bladder is carried on the outside wall of the shroud and is lowered into the well with the other equipment in a deflated condition. An air hose extending from the surface to the bladder is used for bladder inflation when the equipment has been lowered to the desired location in the well. When the bladder is inflated, it provides an annular structure that seals between the shroud and the casing.

When the pump is operated with this equipment in place, water that enters the screen is not subject to aeration from surface air, because the bladder provides a seal against air infiltration from the surface. When the pumping level drops below the level of the top of the screen, a vacuum is applied to the screen to increase the well capacity. The open bottom end of the shroud provides an intake located well below the top of the screen which can enhance the specific capacity of the well. Thus, the detriments of falling water are avoided and the well capacity and performance are enhanced.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figures 1, 2, 3:
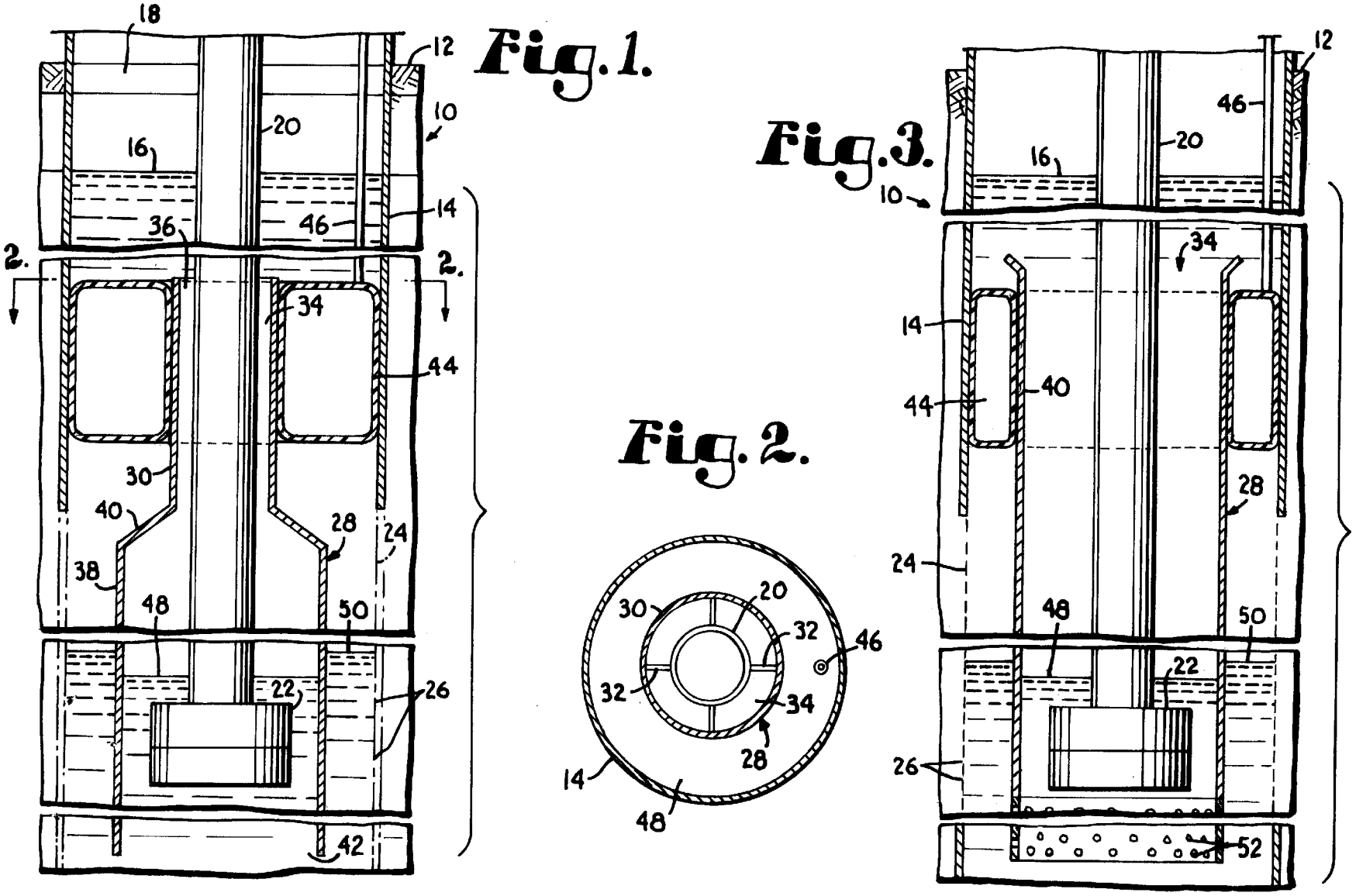
FIG. 1 is a diagrammatic cross-sectional view of a water well in which apparatus constructed according to a preferred embodiment of the present invention is installed, with the break lines indicating continuous length.
FIG. 2 is a cross-sectional view taken generally along line 2—2 of FIG. 1 in the direction of the arrows.
FIG. 3 is a diagrammatic cross-sectional view of a water well in which apparatus constructed according to another embodiment of the invention is installed in a manner to rest on the bottom of the well.

Referring now to the drawings in more detail and initially to FIG. 1, numeral 10 generally designates a water well. Numeral 12 designates the ground surface. The well 10 is lined by a cylindrical casing 14 which extends downwardly from the surface.

The well 10 extends into an aquifer having a static water level at the level indicated by numeral 16. A vertical column pipe 20 is lowered into the well and carries a pump 22 on its bottom end.

Below the static water level 16, the casing 14 has a screen 24 which provides perforations 26 allowing water to enter the well 10 from the aquifer. The perforations 26 can be formed in ways other than by providing the screen 24, such as by forming holes through the wall of the casing.

In accordance with the present invention, a shroud which is generally identified by numeral 28 is connected with the column pipe 20 and located to surround the pump 22. The shroud 28 has an upper portion 30 which is cylindrical. The shroud may also be set onto the bottom of the well casing and does not have to be attached to the pump. As shown in FIG. 2, the connection between the shroud 28 and the column pipe 20 is provided by a plurality of radial arms 32 which extend outwardly from the column pipe 20 and connect at their outer ends with the upper portion 30 of the shroud. This manner of connection leaves an annular flow passage 34 which is substantially open between the shroud 28 and column pipe 20. The shroud 28 has an open top end 36 at the top of portion 30.

The shroud 28 also incudes a lower portion 38 which surrounds the motor 22. The lower portion 38 is cylindrical.

The shroud 28 has an open lower end 42 which is located at the bottom of the portion 38 and which is well below the pump 22. The bottom end can also be screened if desired.

An inflatable and deflatable bladder 44 is attached to the outside surface of the upper shroud portion 30. The bladder 44 is an annular structure which is shown in FIG. 1 in its fully inflated condition. The bladder 44 is inflatable by application of gas or fluid and can be deflated by relieving the pressure from it. In the deflated condition, the bladder 44 collapses to occupy a smaller diameter than in the inflated condition.

An elongated pressure hose 46 connects at one end with the bladder 44 in order to effect inflation and deflation of the bladder. The opposite end of the hose 46 can be connected with suitable equipment such as a compressed nitrogen cylinder or blower (not shown) in order to apply gas of fluid for bladder inflation.

In use, the equipment of the present invention is installed in the well after the casing 14 and screen 24 are in place. The column pipe 20 and pump 22 are lowered into the well using conventional equipment that is commonly used for this purpose. The shroud 28 is connected with the column pipe 20 and is thus lowered into the well along with the column pipe and pump, as is the bladder 44 which is connected with the shroud 28 and which is in its deflated condition while the equipment is being lowered into the well. The column pipe is lowered until the pump 22 has reached the desired level. In wells where the aquifer level has dropped significantly, the pump 22 often must be lowered to a location which is below the top end of the screen 24. This location of pump 22 is shown in FIG. 1. The pump 22 also must be below the pumping level 48 inside of the shroud 28. The pumping level 48 is the level to which the water is drawn down inside of the shroud 28 when the pump 22 is operating to pump water through the column pipe 20 to the surface.

Once the equipment has been lowered to the proper position, gas or fluid is applied through hose 46 for inflation of the bladder 44. The bladder should be located above the top end of the screen 24, as shown in FIG. 1. When the bladder 44 is inflated, it expands until it seals against the casing 14, thereby providing a seal between the shroud 28 and the casing 14 at a location above the top end of the screen 24.

The pump 22 can then be operated to pump water from the well through the column pipe 20 to the surface. When the pump operates, its location within the shroud 28 causes the water level to be drawn down inside of the shroud from the static water level 16 to the pumping level 48. The flow passage 34 provides a route for draw down of the water level and also provides a vent to the surface allowing fluctuation of the water level inside of the shroud.

The water level inside the casing between the casing and shroud is also drawn down to the pumping level identified by numeral 50. Once the water level has been drawn down below the top perforations of the screen 24, a vacuum is applied to the screen interval which enhances the flow of water into the well, and thus increases the specific capacity of the well. When the water level within the casing has dropped below the upper perforations of screen 24, water from the aquifer enters the well through the perforations 26 and falls to the water level within the casing. Because the bladder 44 provides a seal that prevents air infiltration from the surface, the water that falls within the casing is not unduly aerated as would otherwise be the case. In addition to this desirable effect, the bladder 44 assists in stabilizing the shroud 28.

Because the pump 22 is surrounded by the shroud 28, the pump first draws in water that is within the shroud. The shroud intake is located at the open lower end 42 which is below the pump intake. This creates a pressure differential between the inside of the shroud and the outside of the shroud which creates the vacuum effect. The vacuum effect results in the pumping level 50 outside of the shroud being slightly above the pumping level 48 within the shroud.

In this manner, the equipment of the present invention and the method of using it as described avoids undue aeration of the water that is pumped to the surface, and also avoids the creation of aerobic conditions in the well which can lead to bacterial contamination and well plugging. Additionally, the specific capacity of the well is enhanced by the vacuum effect created by the equipment of the present invention. The harmful effects of cavitation on the performance and life of the pump 22 are eliminated, and the need for well maintenance and equipment maintenance is also reduced.

When the pump needs to be raised to the surface for servicing, the bladder 44 can be deflated by relieving the air pressure through the hose 46.

FIG. 3 depicts an alternative arrangement in which the shroud 28 has a constant diameter and is not connected with the column pipe 20. Instead, the shroud 28 rests on the bottom of the well and surrounds the pump. The lower end portion of the shroud 28 is perforated at 52 to provide an inlet to the shroud that is below the pump.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. Apparatus for installation in a well extending into the surface of the ground and having a casing and a subsurface perforated portion of the casing for allowing liquid flow into the well, said apparatus comprising:

a column pipe within the casing having a lower end below the top of said perforated portion;

a submersible pump on said column pipe for pumping water into said lower end and through the column pipe to the surface;

a shroud connected with said column pipe, said shroud surrounding said pump and having an open lower end located below the pump and an open upper end located within the casing above but near said perforated portion thereof;

an inflatable bladder connected with said shroud and having an inflated condition effecting a seal between said shroud and casing below said upper end of the shroud and above said perforated portion of the casing; and means for effecting the inflated condition of said bladder at a location below said upper end of the shroud and above the perforated portion of the casing.

2. Apparatus as set forth in claim 1, wherein said bladder is annular in the inflated condition.

3. Apparatus as set forth in claim 2, wherein said means for effecting the inflated condition of said bladder comprises an inflation line connected with the bladder and extending to the surface of the ground to provide a conduit for applying fluid to the bladder for inflation thereof.

4. Apparatus as set forth in claim 1, wherein said means for effecting the inflated condition of said bladder comprises an inflation line connected with the bladder and extending to the surface of the ground to provide a conduit for applying fluid to the bladder for inflation thereof.

5. Apparatus as set forth in claim 1, including a plurality of arms connecting said shroud with said column pipe in a manner presenting a flow path therebetween.

6. In a water well extending into the surface of the ground and lined by a well casing having a subsurface perforated portion allowing water to enter the well, the improvement comprising:

a column pipe extending from the surface down into the well and having a lower end at a level below the lowest level to which the water in the well drops while pumping of water is effected;

a submersible pump on said lower end of said column pipe operable to pump water therethrough from said lower end to the surface;

a shroud in the well spaced inwardly from the casing and outwardly from the column pipe, said shroud being connected with said column pipe and surrounding said pump;

an open lower end of said shroud located below the pump to allow entry of water into the shroud and flow therein toward the pump;

an open upper end of said shroud located within said casing above but near said perforated portion thereof to allow flow up and down through the shroud into the casing; and an inflated bladder connected with said column pipe, said bladder being annular and providing a seal between the casing and shroud at a location above the perforated portion of the casing and below said upper end of the shroud.

7. The improvement of claim 6, wherein said bladder has inflated and deflated conditions, and including means for effecting the inflated condition of the bladder after it has been lowered with the column pipe to a location above the perforated portion of the casing.

8. The improvement of claim 7, wherein said means for effecting the inflated condition of the bladder comprises an inflation line connected with the bladder and extending to the surface to provide a conduit for application of fluid to the bladder.

9. The improvement of claim 6, including a plurality of spaced apart arms connecting said shroud with said column pipe and maintaining a flow path therebetween.

10. A method of pumping water from a well which is lined by a casing having a subsurface perforated portion and which has a static water level at which water in the well is normally maintained, said method comprising the steps of:

lowering a column pipe carrying a pump into the well to locate the pump at a level below the top of the perforated portion of the casing;

surrounding the pump with a shroud having an open bottom end located below the pump and an open top end located within the casing above but near said perforated portion of the casing to present a substantially annular flow path between the shroud and column pipe;

effecting a seal between the shroud and casing at a location above the perforated portion of the casing; and operating the pump to pump water in the well through said column pipe in a manner effective to lower the water level outside the shroud to a pumping water level lower than the static water level and to a pumping water level inside the shroud that is lower than the pumping water level outside the shroud.

11. A method as set forth in claim 10, wherein said step of effecting a seal comprises:

lowering a bladder in a deflated condition thereof into the well in an annular space between the shroud and casing; and inflating the bladder after it has been lowered to said location above the perforated portion of the casing.

12. Apparatus for installation in a well having a casing and a subsurface perforated portion of the casing for allowing liquid flow into the well, said apparatus comprising:

a column pipe within the casing having a lower end below the top of said perforated portion;

a pump on said column pipe for pumping water into said lower end and through the column pipe to the surface;

a shroud connected with said column pipe, said shroud surrounding said pump and having an open lower end located below the pump;

a plurality of arms connecting said shroud with said column pipe in a manner presenting a flow path therebetween;

an inflatable bladder connected with said shroud and having an inflated condition effecting a seal between said shroud and casing; and means for effecting the inflated condition of said bladder at a location above the perforated portion of the casing.

* * * * *